US006712712B2

(12) United States Patent
Bourque

(10) Patent No.: US 6,712,712 B2
(45) Date of Patent: Mar. 30, 2004

(54) BUTT EXTENDER HAVING A CUSHION-RECEIVING CAVITY FOR A POOL CUE

(75) Inventor: Daniel R. Bourque, Sanford, ME (US)

(73) Assignee: Steven G. Bruno, Sanford, ME (US); part interest ( * ) Notice: Subject to any disclaimer, the term of this patent is extended or adjusted under 35 U.S.C. 154(b) by 43 days.

(21) Appl. No.: 09/900,540

(22) Filed: Jul. 6, 2001

(65) Prior Publication Data

US 2002/0022529 A1 Feb. 21, 2002

Related U.S. Application Data

(63) Continuation-in-part of application No. 29/127,695, filed on Aug. 10, 2000, now Pat. No. Des. 444,519.

(51) Int. Cl.[7] ..... A63D 15/08
(52) U.S. Cl. ..... 473/46; 473/47
(58) Field of Search ..... 473/44–49

(56) References Cited

U.S. PATENT DOCUMENTS 6,027,410 A * 2/2000 Costain et al. ..... 473/44
D444,519 S * 7/2001 Bourque ..... D21/726

FOREIGN PATENT DOCUMENTS

| | | | |
|---|---|---|---|
| FR | 539288 | * 6/1922 | ..... 473/47 |
| GB | 2157576 | * 10/1985 | |
| GB | 2160784 | * 1/1986 | |
| GB | 2169212 | * 7/1986 | |
| GB | 2172210 | * 9/1986 | |
| GB | 2191707 | * 12/1987 | |
| GB | 2191954 | * 12/1987 | |
| GB | 2209681 | * 5/1989 | |

* cited by examiner

*Primary Examiner*—Mark S. Graham
(74) *Attorney, Agent, or Firm*—Stan Jones, Patents

(57) ABSTRACT

The butt end of a standard pool cue is modified by boring a threaded receiving female hole through the center of the butt cushion. A male threaded stub of an extender is sized to fit the butt end of a pool cue, which extender has, at its forward end, a cavity to receive the butt cushion and a center-located threaded bolt that is sized to mate with a threaded bore in the center of the cue cushion. One or more butt extenders are adapted at the butt end to receive other extender sections.

16 Claims, 4 Drawing Sheets

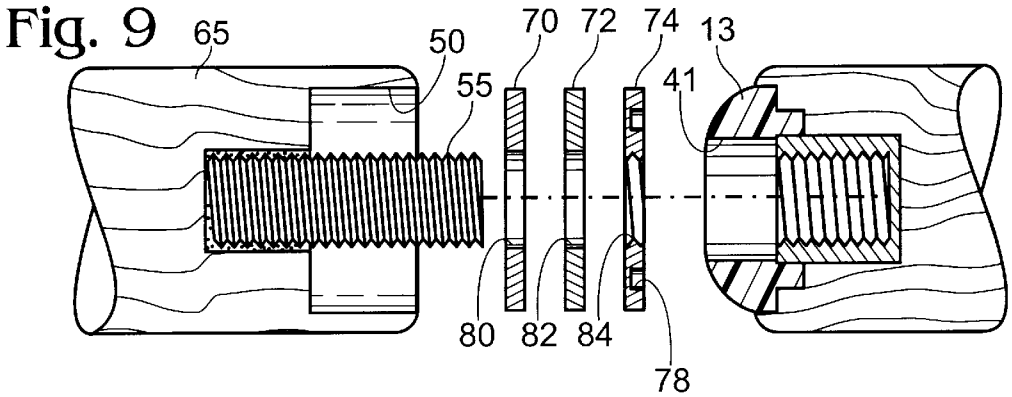
Fig. 9
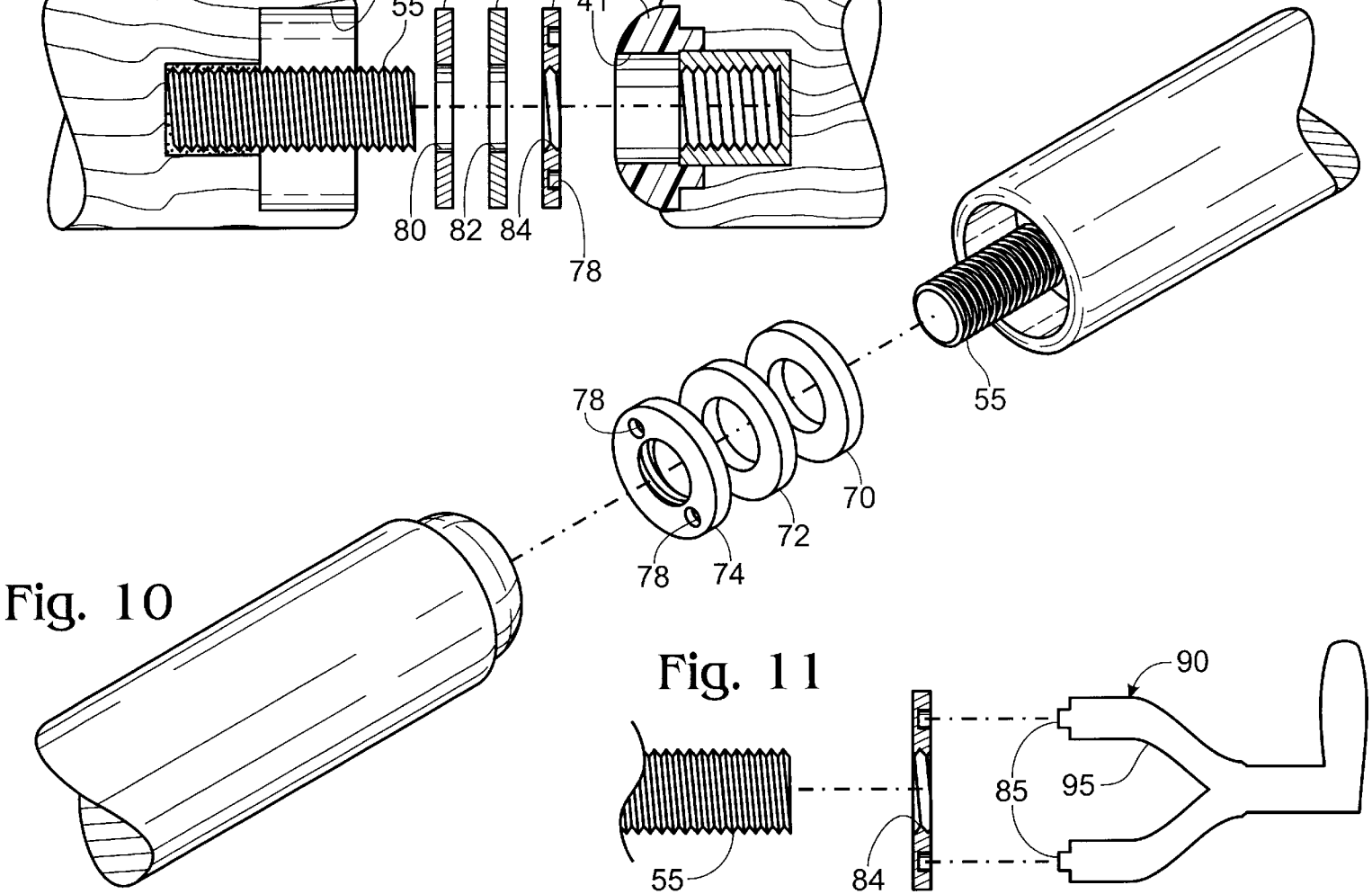
Fig. 10
Fig. 11

BUTT EXTENDER HAVING A CUSHION-RECEIVING CAVITY FOR A POOL CUE

RELATED APPLICATIONS

This application is a continuation-in-part of my application entitled EXTENDER FOR A POOL CUE, filed on Aug. 10, 2000 having Ser. No. 29/127,695 now issued as United States patent D444,519.

FIELD OF THE INVENTION

The field of the present invention relates to pool cues and extenders for same. Further, the field of this pool cue invention relates to one that has one or more butt extenders that may easily and quickly be attached to a standard cue for breaking a rack of cue balls or for play in places having limited space.

EXPLANATION OF TERMS

My invention interfaces and operates in conjunction with pool cue apparatus for playing the sport of pool. Provided below are brief descriptions of certain relevant terms which further the understanding of the invention and provide a basis for a detailed teaching of the improvement in the art provided by this invention.

Pool Cues

All pool cues whether one piece or detachable for ease of carrying and handling have both a tip and a butt end. On the butt or base end a cushion is normally attached by a screw with the cushion serving to protect the cue from damage when same comes into contact with the floor. This invention modifies the butt end of a standard pool cue by boring a threaded receiving female hole through the center of the butt cushion where it is ready to receive a male threaded stub of an extender.

Butt Extender

An extender is sized to fit the butt end of a pool cue and has at its forward end a cavity to receive the butt cushion and a center-located threaded bolt that is sized to mate with the threaded bore in the center of the cue cushion. One or more butt extenders may be connected in tandem in that some of the extenders are adapted at the butt end to receive other extender sections.

BACKGROUND OF THE INVENTION

The game of pool, whether at pastime or professional level, requires various cue sizes, weights and capabilities. Each pool player has his own cue that may be one piece or more often is a sectional device for ease of handling and carrying. Each cue in a ready to play condition has a tip and a butt end.

For the casual player - particularly at home - the pool table may be placed in a crowded area that requires dexterity and inventiveness to carry out some shots around posts and other obstructions surrounding the pool table. One or more extender sections of this invention may take the place of the butt section of a modified pool cue for use in such tight space environments. Such a cue is referred to as "modified" in that its cushion and base end must be adapted to the inventive principles mentioned above under the pool cue and butt extender definitions.

DESCRIPTION OF PRIOR ART

Turning now to the prior art, a search was done by the patent Office for the parent design application and the Examiner cited some art of peripheral relevance. The examination and allowance of the earlier parent application resulted in citation of the following patents.

U.S. Pat. No. 4,526,370 to Mortellacci (July, 1985)

U.S. Pat. No. 5,407,197 to Parsons (April, 1995)

U.S. Pat. No. 5,665,003 to LeBeau (September, 1997)

U.S. Pat. No. 6,117,019 to Taylor (September, 2000)

U.S. Design Patent D-370,955 to Fisher (June, 1996)

The above listed patents have only a very limited relevance and do not achieve either the structure or the functions of the invention as disclosed and claimed herein.

The advantages and inventive nature of my apparatus and method over the aforementioned body of prior art is significantly two fold. First, a user can effectively attach one or more extenders to a modified pool cue. These extenders can vary the usable length and weight of a pool cue so adapted.

Additionally, should a user want to achieve a heavy weighted cue for breaking a rack of balls, the extender series each have cavities that house a user-selected series of weight rings so that a user's particular break requirements may easily and quickly be met by use of my invention.

SUMMARY OF THE INVENTION

The butt extender of this invention fits over the butt end cushion of a pool cue and is adaptable for play in tightly obstructed table areas. Moreover the butt extender has the capability of regulating the weight in the extender portions by a series of weight rings. My method invention includes the novel steps of placing a bore in the center of a butt end cushion in order to receive an extender section that has a male threaded post to mate with the threads of the bore, which extender has a cushion-receiving void that houses the butt cushion of the cue.

My pool cue extender may consist of a series of extender sections of differing lengths. Such extenders are adapted to threadably fit within a modified prior art pool cue. That cue has, at its butt end, a cushion that has been bored centrally along the longitudinal axis of the cue. The inner surface of that bore is threaded to mate with a longitudinally aligned and threaded extender stub which protrudes from the front of an extender section. A cushion-receiving cavity surrounds the stub and is adapted to house the cue cushion when the extender has been added to the modified pool cue.

Further, my extender invention provides a deep elongated cushion-receiving cavity to additionally receive and house a series of washer-like weight rings, some of which have slightly oversized openings that may be dropped over the threaded extender stub before the extender itself is screwed unto the modified pool cue. The outermost weight ring is also threaded such that the extender houses and conceals both the cue cushion and the user-selected weight rings when in an attached condition for play.

Further yet, my extender comes in a series of differing lengths so that any user may select the length and weight that suits him for playing pool. The extender unit may easily and simply be added or removed from the cue without disrupting play and may be carried within the users pocket or case for convenience sake.

OBJECTS OF THE INVENTION

It is an object to provide a longitudinal and threaded bore through the butt cushion of a pool cue in order to modify the cue so that it may receive my extender invention.

It is an object to provide a series of extender sections that may be installed by a user on a pool cue in order to vary the weight and the length to suit that particular user.

It is an object to provide a series of both threaded and unthreaded weight rings that may be housed in a forward or rearward facing cavity which is provided at either end of an extender section.

It is an object to provide for simple hand attachment/removal of pool cue extenders to conceal and house a pool cue cushion in a forward facing cavity of an extender.

It is an object to provide a weight ring spanner wrench that allows the user to tighten threaded weight ring(s) around a protruding stub of an extender.

It is an object to provide a method and apparatus which easily and simply adjusts the length and weight of a pool cue by use of a series of extender and weight ring combinations.

BRIEF DESCRIPTION OF THE DRAWING

FIG. 9 is an exploded view of FIG. 6 and depicts the novel method of installing weight rings along the longitudinal axis of an extender stub and cavity;

FIG. 10 is a rear perspective view showing threaded and non-threaded weight rings aligned for placement in the forward facing cavity of an extender and against the base or butt cushion of a pool cue or another extender section; and FIG. 11 shows a spanner wrench for tightening a threaded outer weight ring unto a threaded extender stub in accordance with my invention.

DESCRIPTION OF EMBODIMENT(S)

Figure 1:
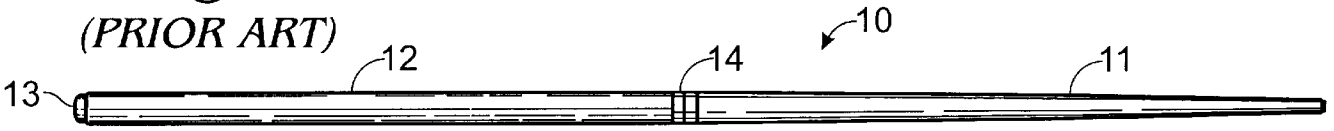
Fig. 1 (PRIOR ART)
FIG. 1 is a plan view of a standard prior art pool cue.

FIG. 1 is a plan view of a standard prior art pool cue 10 having a tip end 11 and a butt end 12. At the base of butt end 12 is a cushion 13 that is normally fastened to the butt section by a screw or other suitable fastening means. Such a prior art cue 10 may be either of the continuous one piece or of the break down variety as both are well known. A break down variety has a centrally positioned coupling 14 for joining the two sections 11 and 12.

Figure 2:
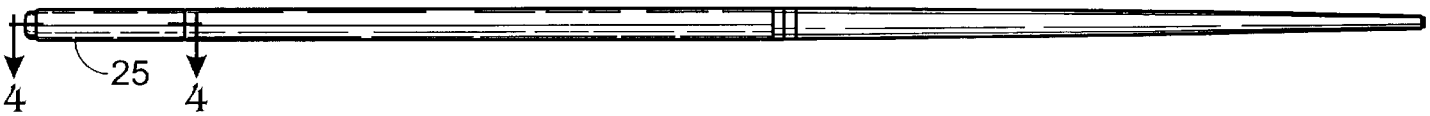
FIG. 2 is another plan view of one extender for a pool cue depicted in an attached position on the lower or butt section of a modified pool cue.

In a preferred embodiment, shown in FIG. 2, one extender 25 of my invention may be joined manually to a modified pool cue 10 of FIG. 1. Sectional line 4—4 taken along the modified and extended cue 30 of FIG. 2 shows the nature and extent of modification required for a prior art cue 10 of the type shown in FIG. 1.

Figure 4:
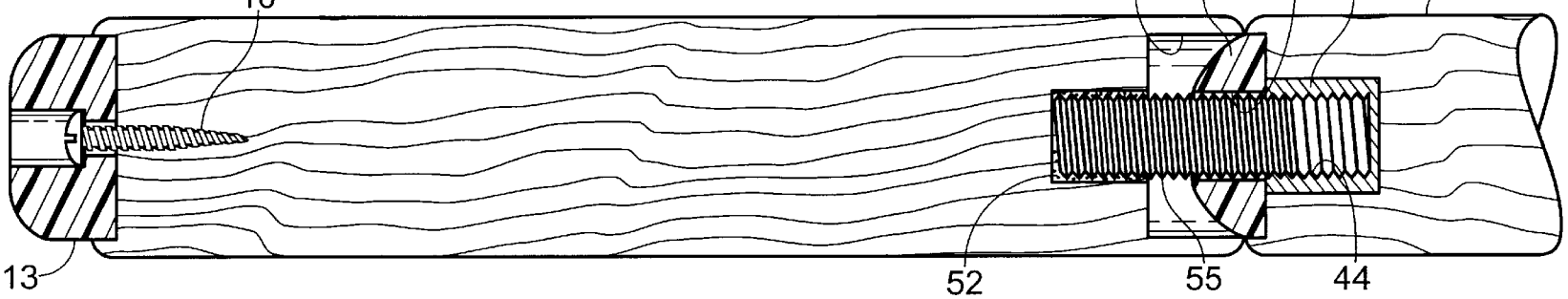
FIG. 4 is a cross section of FIG. 2 taken along the lines 4—4 and showing a single extender section housing a pool cue cushion on the butt end of a pool cue.

FIG. 4 is an enlarged cross section showing that the cushion 13, FIG. 1, has been provided with a central longitudinally positioned bore 41 that extends through the recess area normally occupied by a screw (not shown). Bore 41 extends into the butt end proper of the cue base 38 and has a fitting 42 that is secured to the base 38 by any suitable means such as cement or the like. Fitting 42 has a continuous series of internal threads 44.

Butt extender 25 has a forward facing concave cavity 50 and a bore 52 for housing a male stub 55 that is threaded at an exposed forward end thereof to mate with the threads 44 of the cue 30. Extender stub 55 is secured by cement or otherwise in the extender cavity and is centrally positioned for mating alignment with the butt end of modified cue 30.

At the other end of extender 25 may be located a standard cushion 13 which is fastened to the base of extender 25 by a screw 16. This extender 25 may be carried in a pocket or purse pack of the player for convenience of attachment/removal as play demands.

Figure 3:
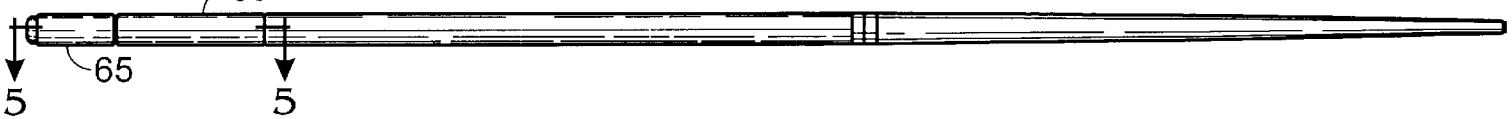
FIG. 3 is another plan view showing two extender sections attached to a modified pool cue.
Figure 5:
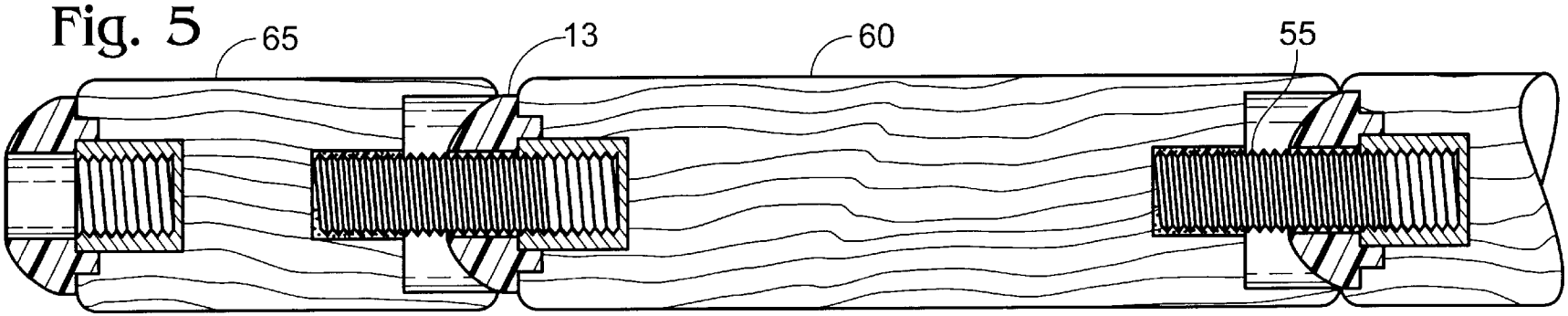
FIG. 5 is a cross section of FIG. 3 taken along the lines 5—5 and showing two tandem-connected extender sections housing a pool cue cushion and an extender cushion as well.

FIG. 3 depicts a cue 30 having a multiplicity of extenders in use. Sectional arrows 5–5 on FIG. 3 depict a cross sectional area along both extenders 60 and 65. As shown in FIG. 5, extender 60 has both opposed ends bored and provided with a stub 55 in the manner earlier described for FIG. 4. Additionally, however, FIG. 5 depicts that extender 60 has, at the opposed - or rearward - end remote from stub 55 a cushion 13 that has been bored and fitted with internal threads in the manner earlier described for the forward facing end of the extender 25 of FIG. 4. Extender 60 is thus attached to a cue as required for play but in this instance the user has elected to add an additional weight free extender 65 in tandem with extender 60.

Figures 7, 8:
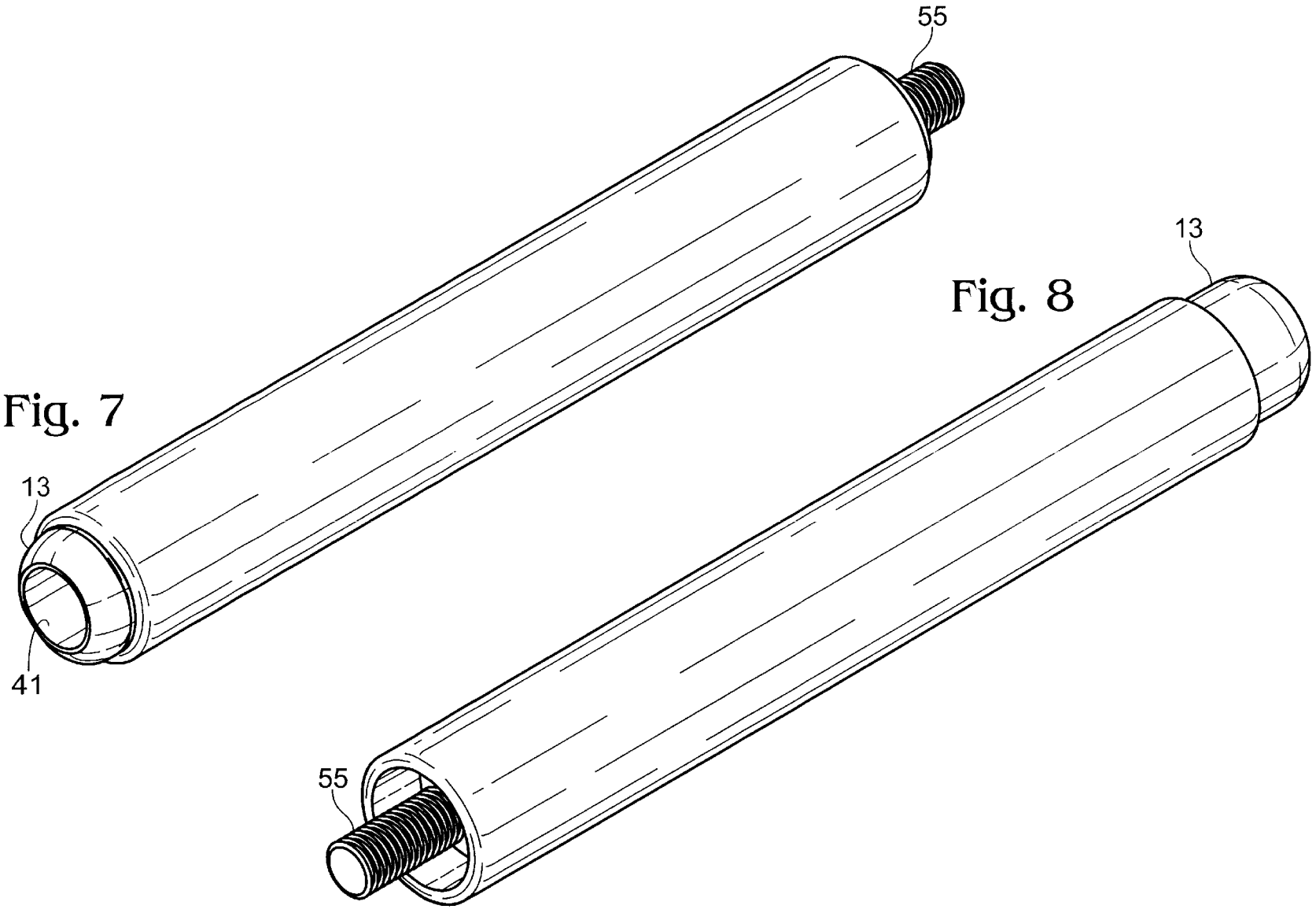
FIG. 7 is a rear perspective view of a single extender for a pool cue.
FIG. 8 is a front perspective view of the extender of FIG. 7.

FIGS. 7 and 8 show in perspective views the general configuration of both ends of an extender such as extender 60 of FIG. 5. FIG. 7, has the bore 41 of FIG. 4 clearly depicted as well as depicting the stub end of a threaded shaft 55.

Figure 6:
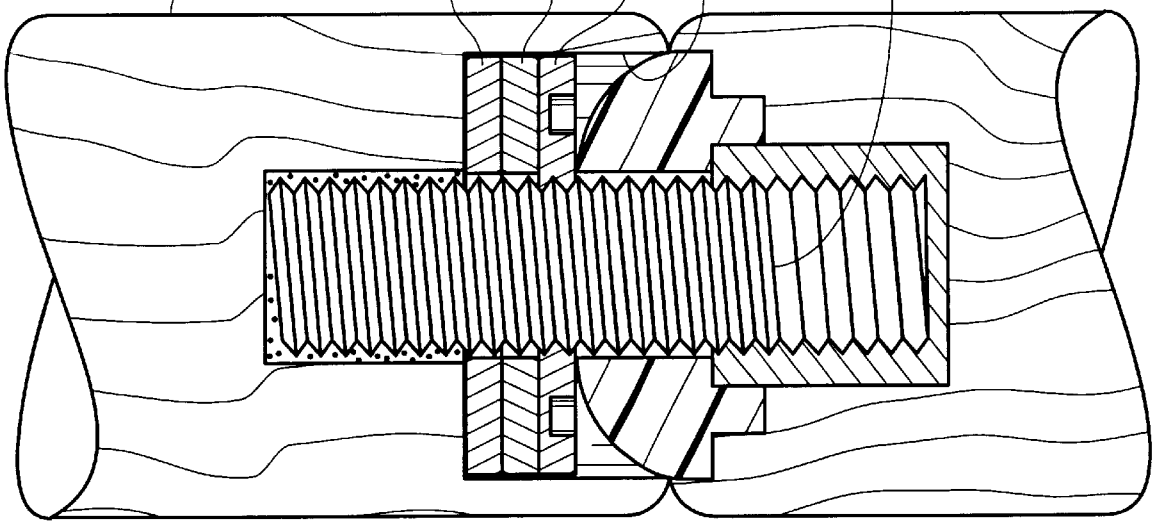
FIG. 6 is a partial cross sectional view showing three weight rings received in and concealed within a cavity in the forward facing end of an extender section.

Turning now to FIG. 6, an enlarged section shows that the deep elongated cavity 50 has been provided with three weight rings 70, 72 and 74. These rings have been seated in the closed end of cavity 50 and the deepest rings 70 and 72 are shown lacking any threads, whereas ring 74 has mating threads that allow outermost ring 74 to be threaded securely unto the stub shaft 55 of extender section 65.

FIGS. 9 through 11 demonstrate the manner in which a user may choose to select and install weight rings 70, 72 and 74 for any given play situation which may be encountered. FIG. 9 depicts in dashed lines a centrally positioned longitudinal axis through the center of stub shaft 55 and bore 41. Such weight rings may take the form of heavy washer-like configuration and may be selected of steel, lead or other suitably heavy material as is well known in the art.

Rings 70 and 72 have centrally positioned oversized openings 80 and 82, respectively, such that they may easily be slipped over the stub shaft 55. A central bore 84 for outermost weight ring 74 is suitably threaded to engage and mate with stub shaft 55 of extender 60. This outermost weight ring 74 additionally is provide with a pair of span recesses 78 that are diagonally located on a weight ring diameter for ring 74.

FIG. 11 depicts a spanner wrench 90 having a pair of opposed prong inserts 85 which are adapted to tit within the indents 78 of weight ring 74. A user simply spins weight ring 74 unto stub 55 and throat 95 of wrench 90 is deep enough to allow tightening of ring 74 into place in cavity 50 of FIG. 9. Obviously only three weight rings have been shown but any suitable number are available to the user in order to allow such an artisan to select the length and weight of cue a particular play situation requires.

While my invention has been described with reference to a particular example of preferred embodiments, it is my intention to cover all modifications and equivalents within the scope of the following claims. It is therefore requested that the following claims, which define my invention, be given a liberal interpretation which is within the spirit and scope of my contribution to this art.

What is claimed is:

1. A pool cue with optional cue weights in combination with an extender that is adapted to fit over a butt end cushion of the cue, the combination comprising:

a cushion affixed to the butt end of said cue, having therethrough a longitudinal central bore, which bore extends beyond the cushion and into the butt end of said cue;

a forward facing end of said extender having an externally threaded longitudinal stub shaft extending out of and away from a cavity which is located in the forward end of said pool cue extender;

said cavity of said extender defined by a cylindrical upstanding wall of said forward facing end and a depth sufficiently surrounding said stub shaft for housing therein said weights, if any, and/or said butt end cue cushion when said extender is thread onto said cue; and said bore, when viewed in cross section having internal threads within said cue butt end that align and mate with said external threads on the stub shaft such that said extender may be secured manually to the butt end of said pool cue, and further, such that user removal of said extender exposes said affixed butt end cushion on said cue.

2. The combination of claim 1 and further comprising:

one or more washer-like weight rings for regulating the weight of an extended cue; and such weight rings sized with a central opening which allows said rings to nest rearward of said cushion-receiving portion of said extender cavity.

3. The combination of claim 2 and further comprising:

a series of said washer-like weight rings, some of which have slightly oversized openings that may be dropped over the threaded extender stub before the extender itself is screwed unto the modified pool cue; and the outermost weight ring thereof having a central opening internally threaded to mate with said external threads on said extender stub shaft.

4. The combination of claim 3 and further comprising:

said outermost threaded weight ring is also provided with an outwardly facing pair of opposed indents of sufficient depth to receive a pair of spaced prongs of a spanner wrench while so nested: and a spanner wrench having spaced prongs and a throat that is deep enough to allow a user to thread the outermost ring unto said stub shaft such that said threaded weight ring is securely housed and concealed within said cavity.

5. The combination of claim 1 and further comprising:

a series of extender sections of differing lengths, with each extender section being fitted to mate with another extender section in tandem so as to extend the length of a pool cue;

at least one of said differing length extender sections having a forward and rearward end with a convex cushion affixed at said rearward end, a bore through said convex cushion, and internal threads in said bore, which threads are adapted to mate with a threaded stub shaft extending from a cushion-concealing cavity in a tandem extender section.

6. The combination of claim 1 and further comprising:

each extender section also having a rearward end fitted at said rearward end with a cushion having located centrally therethrough a bore adapted to receive a threaded shaft of another extender section.

7. A pool cue in combination with an extender having a rearward and a forward end, which extender is adapted to fit over the butt end cushion of a pool cue for user adaptability for playing the game of pool, said extender comprising;

a forward facing threaded stub shaft extending out of and away from a concave cavity located in said forward end of said pool cue extender, which cavity surrounds said threaded stub shaft;

said cavity defined by an upstanding wall at said forward face with a depth dimension adapted to receive and house said butt end cushion of said cue within said cavity;

a mating bore positioned through said base cushion and into a butt end of a pool cue, which bore has internal threads that align and mate with the threads on said threaded stub shaft such that said extender may be secured to and/or manually removed from the butt end of said pool cue;

weight means which may be selectively housed in said cavity for varying the weight of an extended pool cue equipped with said extender; and a second cushion fastened at the rearward end of said extender, which second cushion also has a bore therethrough for receiving a threaded stub shaft of another extender, which other extender also has a second cavity surrounding another second threaded stub shaft for housing, receiving and concealing said second cushion.

8. A method of adding to a pool cue optional cue weights, if any, and an extender, which extender has a rearward and forward end, with the forward end adapted to fit over the butt end of a bored-through cushion of said pool cue for user adaptability for playing the game of pool, said method comprising;

locating a cavity in the forward end of said pool cue extender by a cylindrical upstanding wall of the extender;

installing a forward facing stub shaft in the facing end of an extender, which shaft extends out of and away from said cavity, surrounding the stub shaft by an empty donut-shaped space between said shaft and the upstanding wall;

sizing the dimensions of said cavity with said space being sufficient to receive and house therein a cushion from the butt end of a pool cue or another extender section;

manually selecting optional cue weights for adjusting the weight of said cue;

housing in said cavity said butt end cue cushion alone and/or with said weights; and adapting a mating bore positioned through said base cushion and into said butt end of said pool cue, with internal threads that align and mate with threads on said stub shaft.

9. The method of extending a pool cue in accordance with claim 8 and further comprising:

regulating the weight of an extended cue by the installation in said extender of one or more washer-like weight rings;

sizing such weight rings such that said rings slip over said stub shaft; and nesting said weight rings within said cavity in said extender.

10. The method of extending a pool cue in accordance with claim 8 and further comprising:

fashioning a series of washer-like weight rings;

equipping some of said weight rings with slightly oversized openings relative to said stub shaft; and slipping said weight rings over the threaded extender stub before screwing the extender itself onto said modified pool cue.

11. The method of extending a pool cue in accordance with claim 10 and further comprising:

threading the outermost weight ring with threads adapted to mate with the threads on said extender stub shaft.

12. The method of extending a pool cue in accordance with claim 11 and further comprising:

providing said outermost weight ring with a pair of opposed indents of sufficient depth to receive a pair of spaced prongs of a spanner wrench: and equipping said spanner wrench with spaced prongs and a throat that is deep enough to allow a user to thread the outermost ring onto said stub shaft; and securely housing within said cavity said threaded weight ring.

13. The method of extending a pool cue in accordance with claim 8 and further comprising:

providing to a player a series of extender sections of differing lengths;

fitting each extender section such that it mates with another extender section in tandem; and extending the length of a pool cue by a number of tandem connections so as to suit a particular user.

14. The method of extending a pool cue in accordance with claim 8 and further comprising:

fitting selected extender sections with a cushion held in place by a fastening means at the butt end of the so fitted extender section.

15. The method of extending a pool cue in accordance with claim 8 and further comprising:

fitting selected extender sections at the rearward end thereof with a cushion; and centrally locating through said cushion a bore adapted to receive a threaded shaft of another extender section; and extending the length of said cue by threading into place at said bore another extender section.

16. In a multi-piece pool cue having a cue section with a base end and a convex bumper affixed thereto, a manually coupled extension piece coupled at a central longitudinal opening located on a longitudinal center axis for said cue by separated yet connectable threaded female and male connectors located and secured in the pool cue and in the extension piece, respectively, together with manually selectable cue weights for adjusting the weight of said cue, the improvement comprising:

said convex bumper has a longitudinal female opening bored through said cushion and threaded into said base end of said cue; and said extension piece has a mating threaded male stub shaft which:

A. lies along said longitudinal axis,

B. is secured in said extension piece, and

C. extends forward and beyond a concave cavity which is located in a forward facing end of said extension piece with sufficient threaded male portion exposed beyond said extension piece forward end for mating with the female threads in said cue base end after passing through said bore in said cushion; and said cavity formed by a thin cylindrical upstanding wall of said extension piece and including a void space between an interior wall surface and the cylindrical stub shaft exterior for receiving therein said weights if any and/or the affixed cushion alone for housing same in said void space.

* * * * *